US008621838B1

(12) United States Patent
Hill

(10) Patent No.: US 8,621,838 B1
(45) Date of Patent: Jan. 7, 2014

(54) PNEUMATICALLY-OPERATED MASTER CHAIN LINK PRESS TOOL

(71) Applicant: George W. Hill, Arcadia, FL (US)

(72) Inventor: George W. Hill, Arcadia, FL (US)

( * ) Notice: Subject to any disclaimer, the term of this patent is extended or adjusted under 35 U.S.C. 154(b) by 0 days.

(21) Appl. No.: 13/868,172

(22) Filed: Apr. 23, 2013

(51) Int. Cl.
*B21L 9/06* (2006.01)
*B21L 21/00* (2006.01)

(52) U.S. Cl.
USPC ..... 59/7; 59/11; 59/35.1

(58) Field of Classification Search
USPC ..... 59/5, 7, 8, 9, 11, 35.1
See application file for complete search history.

(56) References Cited

U.S. PATENT DOCUMENTS

| | | | | |
|---|---|---|---|---|
| 1,436,429 | A | 11/1922 | Bean | |
| 2,361,971 | A | 11/1944 | Shipman | |
| 2,783,611 | A | 3/1957 | Simpkin et al. | |
| 4,543,818 | A * | 10/1985 | Moriki et al. | 59/5 |
| 4,833,875 | A | 5/1989 | Buermann, Jr. et al. | |
| 5,203,158 | A | 4/1993 | Bowers | |
| D340,172 | S | 10/1993 | Her | |
| 6,453,657 | B1 | 9/2002 | Teravainen | |
| 6,490,853 | B1 * | 12/2002 | Winklhofer et al. | 59/7 |
| 6,951,096 | B2 * | 10/2005 | Maguire et al. | 59/7 |
| 7,797,920 | B2 | 9/2010 | Wang | |
| 8,117,819 | B2 | 2/2012 | Scott | |
| 2011/0179761 | A1 | 7/2011 | Yu | |

* cited by examiner

*Primary Examiner* — David B Jones
(74) *Attorney, Agent, or Firm* — Kyle Fletcher

(57) ABSTRACT

The pneumatically-operated master chain link press tool is a press tool that is configured to press on a master link plate onto master link pins of a drive chain. The press tool includes a cylinder inside of which is a pneumatically-driven piston that is spring-loaded in order for the piston to return to a retracted position after pressing the master link plate onto the master link pins. A distal end of the cylinder includes a master link support jig that is partially exposed via a side opening. The master link support jig includes a master link recess that is configured to support a master link body of a drive chain there against. An opposing distal end of the cylinder includes a compressed air inlet and an air release. The compressed air inlet is configured for attachment and use with a compressed air hose.

18 Claims, 5 Drawing Sheets

PNEUMATICALLY-OPERATED MASTER CHAIN LINK PRESS TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of drive chain tools, more specifically, a pneumatically-operated press tool that installs master chain links onto a drive chain.

B. Discussion of the Prior Art

As will be discussed immediately below, no prior art discloses a press tool that is configured for pressing on a master link onto a drive chain; wherein the press tool includes a cylinder inside of which is a pneumatically-driven piston that is spring-loaded in order for the piston to return to a retracted position; wherein a distal end of the cylinder includes a master link support jig that is partially exposed via a side opening; wherein the master link support jig includes a master link recess that is configured to support a master link body of a drive chain there against; wherein an opposing distal release; wherein the compressed air inlet is configured for attachment and use with a compressed air hose; wherein the pneumatically-driven piston includes a master link face that is configured for use with a master link plate such that the master link plate is pressed onto the master link pins of the master link body; wherein the compressed air hose emits a burst of compressed air that is used to drive the piston thereby pressing the master link plate onto the master link pin of the master link body, and immediately thereafter spring members retract said piston in order to remove the drive chain therefrom.

The Scott Patent (U.S. Pat. No. 8,117,819) discloses a chain repairing tool that is configured for pressing side plates of chain links. However, the tool does not use a piston with a master link face and master link support jig.

The Wang Patent (U.S. Pat. No. 7,797,920) discloses a tool device that is used to assemble and disassemble a drive chain. However, the tool is not a pneumatically-driven press that is particularly adapted to press master link plates onto master link pins, and which further supports the master link body.

The Buermann, Jr. et al. Patent (U.S. Pat. No. 4,833,875) discloses a tool that is used to assemble a master link to a motorcycle drive chain. Again, the tool is not a penumatically-driven tool that supports the master link body, and further includes a piston to press the master link plate onto the master link pins.

The Simpkin et al. Patent (U.S. Pat. No. 2,783,611) discloses a device for assembling side plates and heading rivets in roller chains. Again, the tool does not rely on a compressed air source to drive a piston, which presses on a master link plate onto a master link pin.

The Yu Patent Application Publication (U.S. Pub. No. 2011/0179761) discloses a clamping tool for assembling or disassembling a chain structure. Again, the tool does not rely on a compressed air source to drive a piston, which presses on a master link plate onto a master link pin.

The Bean Patent (U.S. Pat. No. 1,436,429) discloses a chain repair tool. Again, the tool does not rely on a compressed air source to drive a piston, which presses on a master link plate onto a master link pin.

The Shipman Patent (U.S. Pat. No. 2,361,971) discloses a tool for repairing a drive chain. Again, the tool does not rely on a compressed air source to drive a piston, which presses on a master link plate onto a master link pin.

The Bowers Patent (U.S. Pat. No. 5,203,158) discloses a device for inserting and removing pins from a roller chain. Again, the device does not rely on a compressed air source to drive a piston, which presses on a master link plate onto a master link pin.

The Her Patent (U.S. Pat. No. Des. 340,172) illustrates a design for a chain disassembling tool, which does not depict a pneumatically-driven piston.

While the above-described devices fulfill their respective and particular objects and requirements, they do not describe a press tool that is configured for pressing on a master link onto a drive chain; wherein the press tool includes a cylinder inside of which is a pneumatically-driven piston that is spring-loaded in order for the piston to return to a retracted position; wherein a distal end of the cylinder includes a master link support jig that is partially exposed via a side opening; wherein the master link support jig includes a master link recess that is configured to support a master link body of a drive chain there against; wherein an opposing distal end of the cylinder includes a compressed air inlet and an air release; wherein the compressed air inlet is configured for attachment and use with a compressed air hose; wherein the pneumatically-driven piston includes a master link face that is configured for use with a master link plate such that the master link plate is pressed onto the master link pins of the master link body; wherein the compressed air hose emits a burst of compressed air that is used to drive the piston thereby pressing the master link plate onto the master link pin of the master link body, and immediately thereafter spring members retract said piston in order to remove the drive chain therefrom. In this regard, the pneumatically-operated master chain link press tool departs from the conventional concepts and designs of the prior art.

SUMMARY OF THE INVENTION

The pneumatically-operated master chain link press tool is a press tool that is configured to press on a master link plate onto master link pins of a drive chain. The press tool includes a cylinder inside of which is a pneumatically-driven piston that is spring-loaded in order for the piston to return to a retracted position after pressing the master link plate onto the master link pins. A distal end of the cylinder includes a master link support jig that is partially exposed via a side opening. The master link support jig includes a master link recess that is configured to support a master link body of a drive chain there against. An opposing distal end of the cylinder includes a compressed air inlet and an air release. The compressed air inlet is configured for attachment and use with a compressed air hose. The pneumatically-driven piston includes a master link face that is configured for use with a master link plate such that the master link plate is pressed onto the master link pins of the master link body. The compressed air hose emits a burst of compressed air that is used to drive the piston thereby pressing the master link plate onto the master link pin of the master link body, and immediately thereafter spring members retract said piston in order to remove the drive chain therefrom.

It is an object of the invention to provide a hand-held press tool that includes a pneumatically-driven piston, which is configured to drive a master link plate onto master link pins of a master link body for a drive chain.

A further object of the invention is to provide a pneumatically-driven piston, which includes spring members to recoil the piston after the piston presses the master link plate onto the master link pins of the master link body.

A further object of the invention is to provide a master link support jig that is an extension of a cylinder, and which includes a master link recess that is configured to support a master link body of a drive chain there against.

These together with additional objects, features and advantages of the pneumatically-operated master chain link press tool will be readily apparent to those of ordinary skill in the art upon reading the following detailed description of presently preferred, but nonetheless illustrative, embodiments of the pneumatically-operated master chain link press tool when taken in conjunction with the accompanying drawings.

In this respect, before explaining the current embodiments of the pneumatically-operated master chain link press tool in detail, it is to be understood that the pneumatically-operated master chain link press tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the pneumatically-operated master chain link press tool.

It is therefore important that the claims be regarded as including such equivalent construction insofar as they do not depart from the spirit and scope of the pneumatically-operated master chain link press tool. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
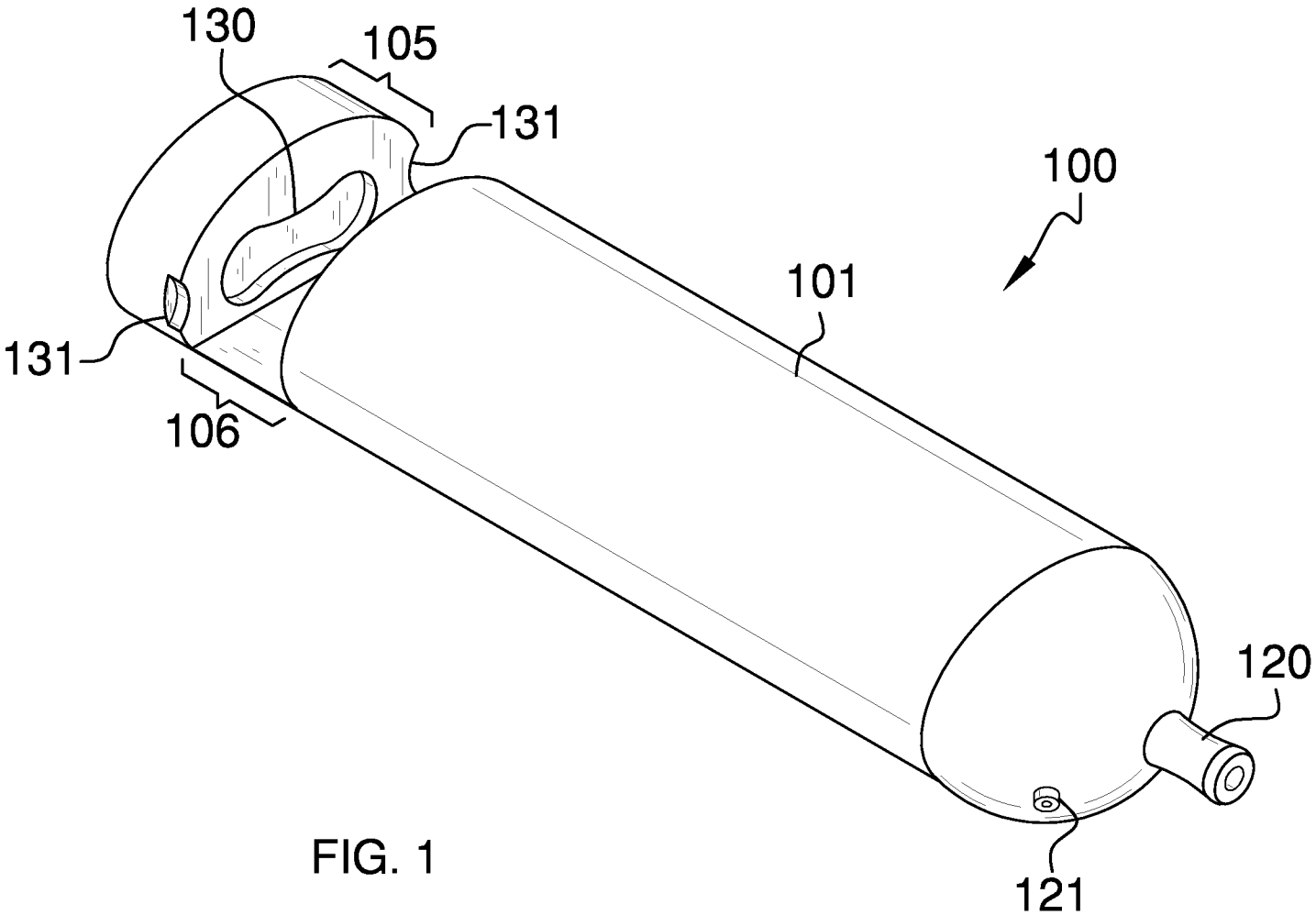
FIG. 1 illustrates a forward, perspective view of the pneumatically-operated master chain link press tool by itself.
Figure 2:
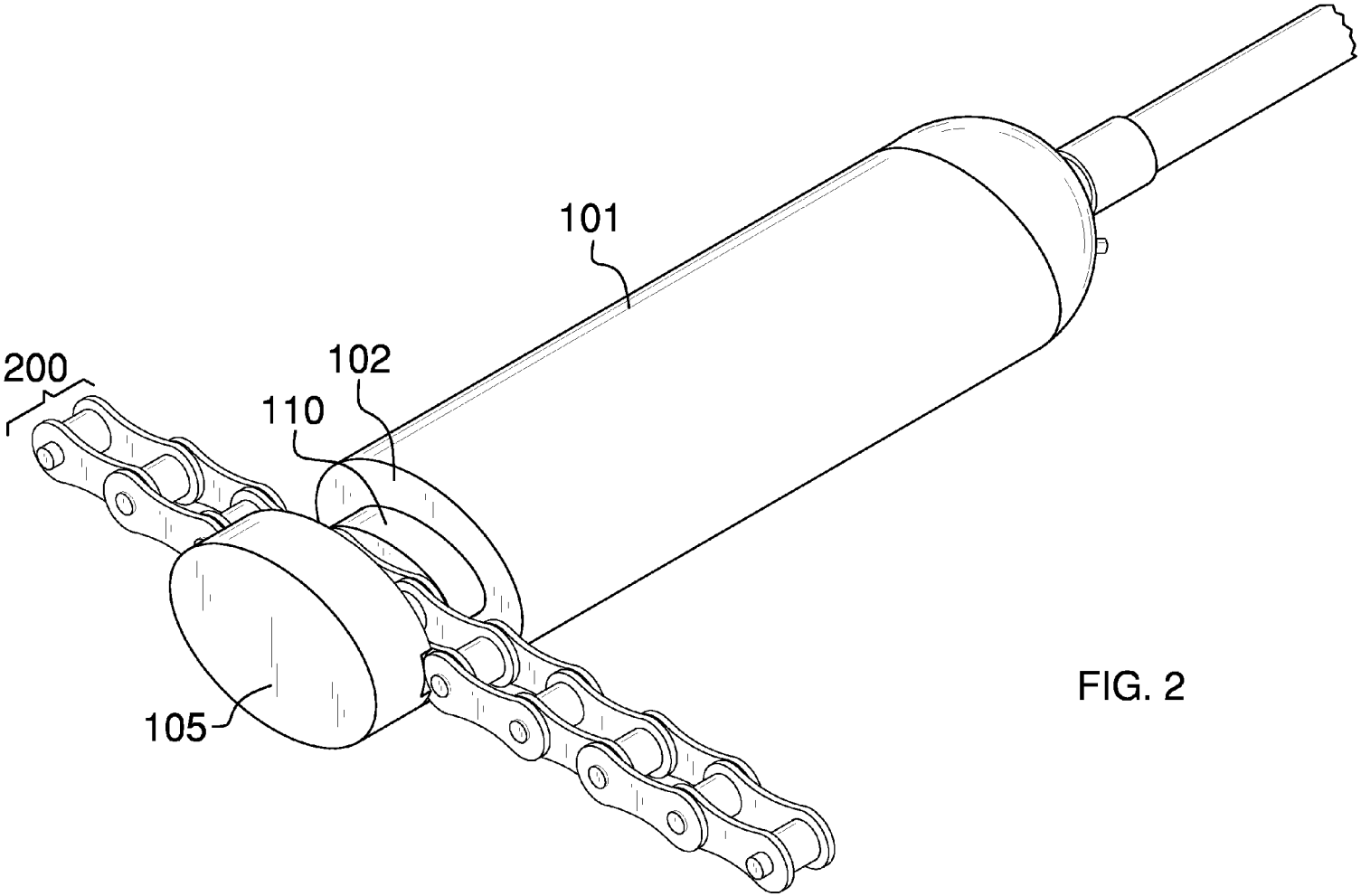
FIG. 2 illustrates a rearward, perspective view of the pneumatically-operated master chain link press tool in use with both a compressed air hose and a drive chain positioned into the master link support jig.
Figure 3:
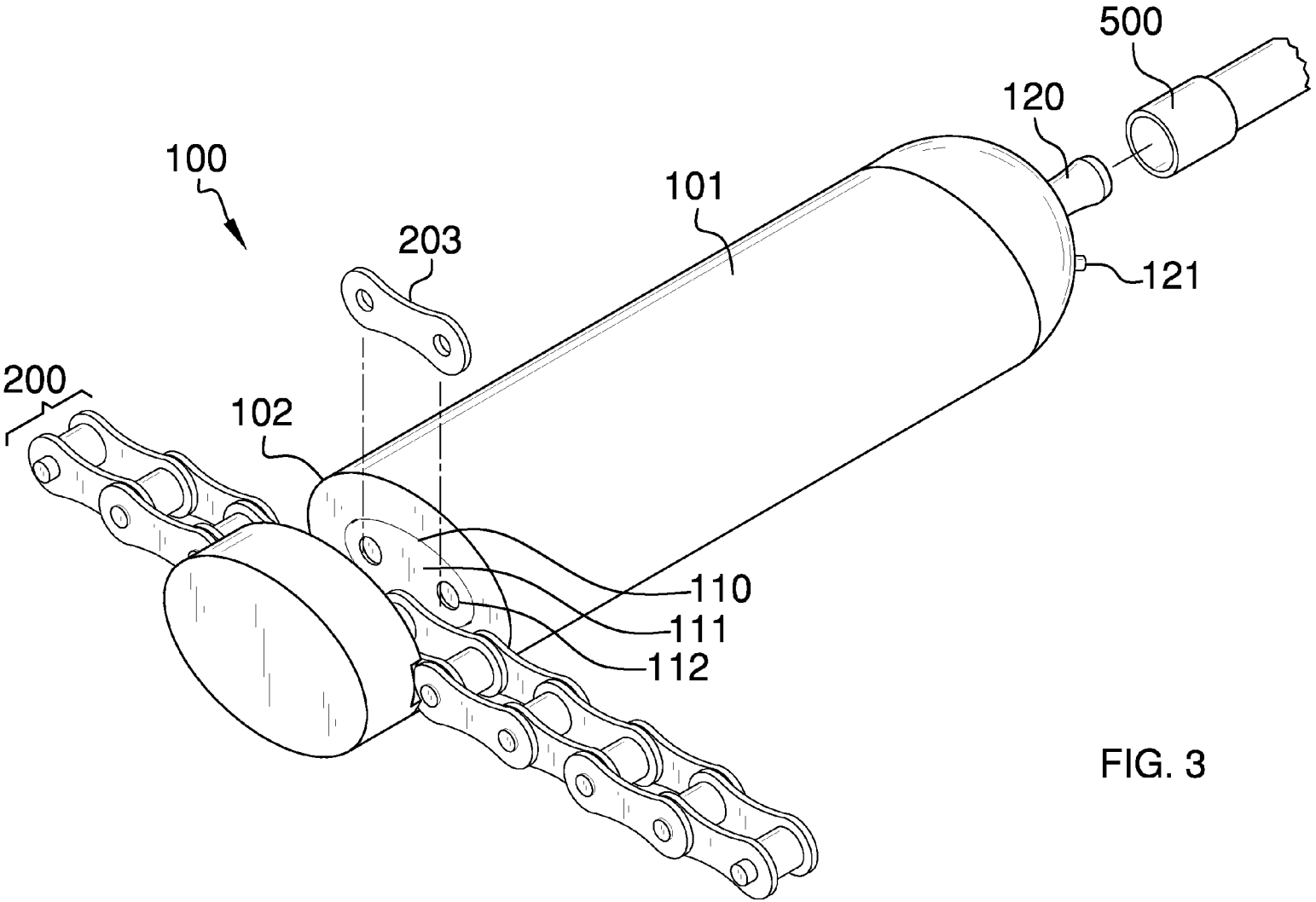
FIG. 3 illustrates a rearward, perspective view of a master link plate aligned with respect to the pneumatically-driven piston.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A pneumatically-operated master chain link press tool 100 (hereinafter invention) includes a cylinder 101 further defined with a first distal end 102, and including a piston 110 that is able to move back and forth within the cylinder 101. The first distal end 102 is further defined with a master link support jig 105 that is accessed via a side opening 106. An opposing distal end 103 of the cylinder 101 includes a compressed air inlet 120 and an air release 121.

The master link support jig 105 is essentially a master link body recess 130 and link contours 131 that face the first distal end 102 of the cylinder 102. The side opening 106 is further defined with an opening width 108. The opening width 108 of the side opening 106 shall be ample enough to enable a drive chain 200 to be inserted and removed when in use with the invention 100. The drive chain 200 is further defined with a master link 201 that is comprised of master link pins 202 coupled with master link plates 203. The job or primary function of the invention 100 is to press the master link plates 203 onto the master link pins 202 in order to close off the loop forming the drive chain 200.

The master link body recess 130 and link contours 131 are specially shaped and spaced from one another in order for the master link 201 of the drive chain 200 to be secured onto the master link support jig 105. Moreover, the master link body recess 130 and link contours 131 support the master link 201 at a strike distance 132 (see FIG. 5) from the first distal end 102 of the cylinder 101 such that the piston 110 is able to extend in order to press the master link plate 203 onto the master link pins 202.

The piston 110 is further defined with a master link face 111 that actually impacts the master link plate 203. Moreover, the master link face 111 includes pin recesses 112 thereon, which enable the master link pins 202 to extend through the master link plate 203.

Figure 4:
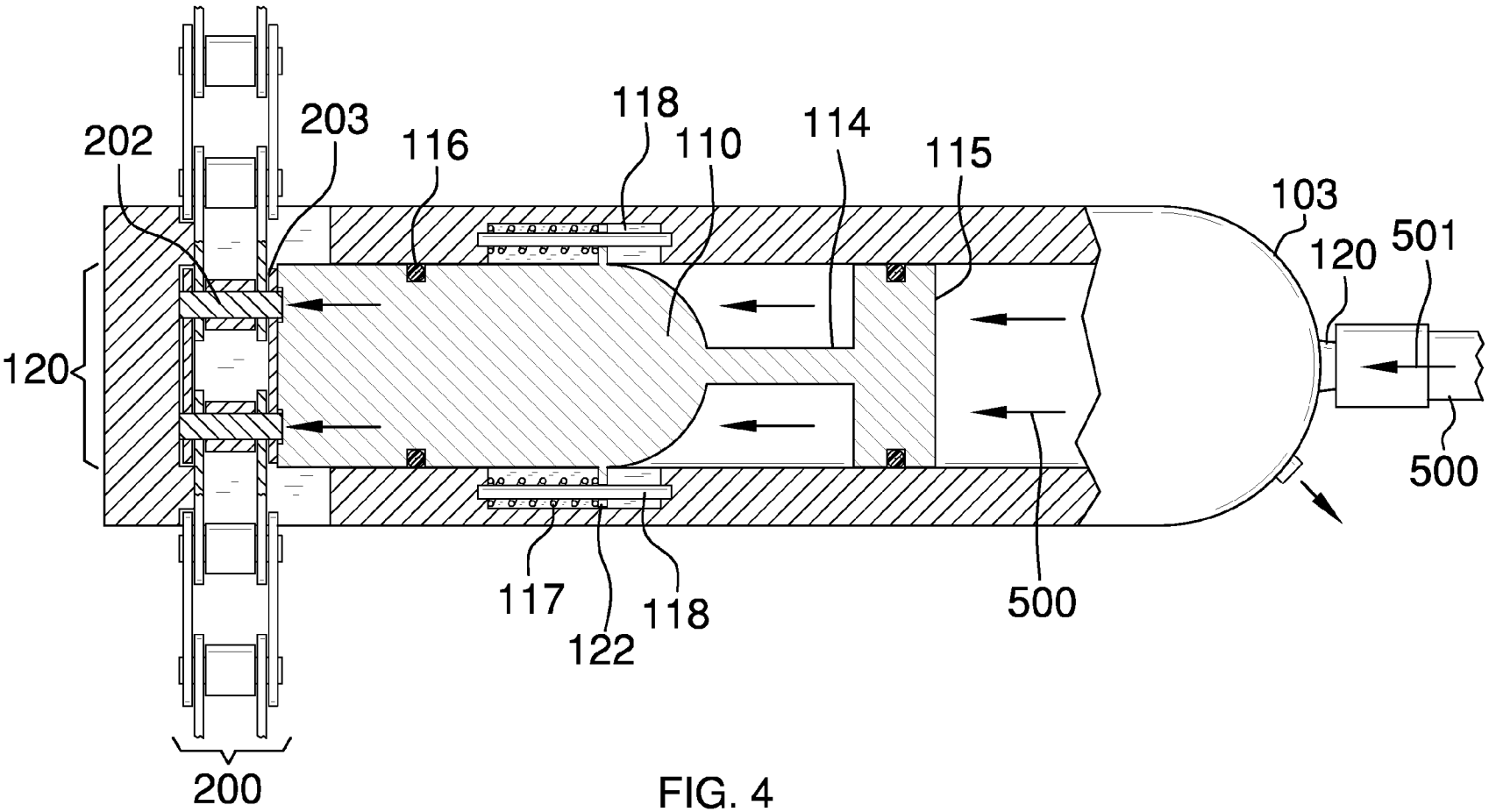
FIG. 4 illustrates a cross-sectional view of the pneumatically-operated master chain link press tool in use, and depicting the piston pressing a master link plate onto master link pins.
Figure 5:
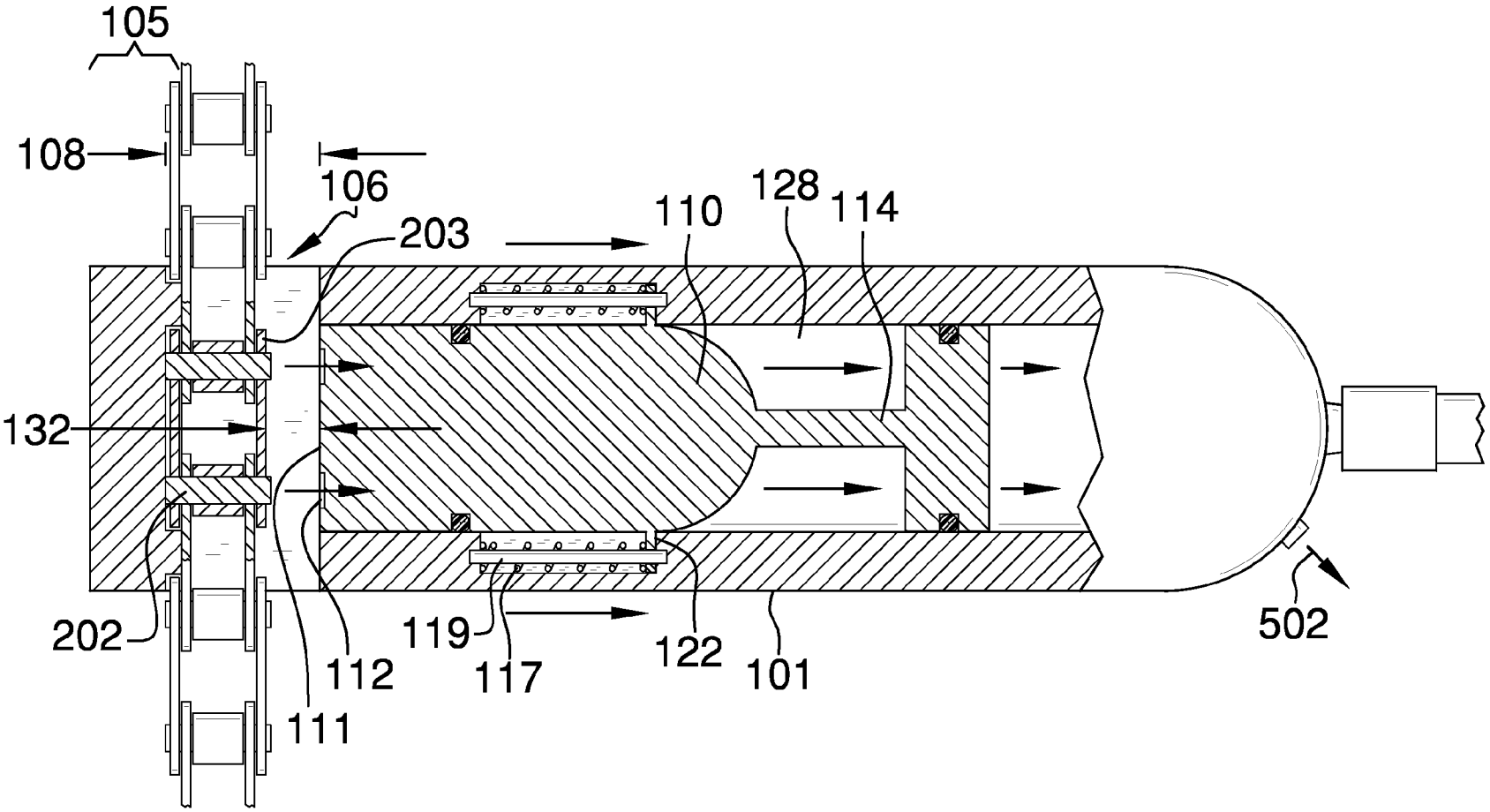
FIG. 5 illustrates another cross-sectional view of the piston retracting after the pressing action of the piston.

Referring to FIGS. 4-5, the piston 110 is able to slide back and forth within the cylinder 101. The piston 110 includes a neck 114 that is located in between the master link face 111 and a compressed air surface 115. A plurality of bearings 116 are outfitted on the piston 110 to ensure laminar movement of the piston 110 back and forth within the cylinder 101. The cylinder 101 includes springs 117 that are supported within spring recesses 118 located inside of the cylinder 101. Moreover, the springs 117 are held in place via spring rods 119 that are rigidly affixed within the spring recesses 118. The piston 110 includes spring tabs 122 that engage the springs 117 such that the piston 110 is biased into a retracted position. moreover, the springs 117 bias the piston 110 to the retracted position, which pulls the piston 110 towards the opposing distal end 103.

The opposing distal end 103 of the cylinder 101 includes the compressed air inlet 120 and the air release 121. The compressed air inlet 120 enables a compressed air hose 500 to connect with the invention 100 in order to supply compressed air 501, which is used to operate the invention 100. The compressed air hose 500 supplies the compressed air 501 into the cylinder 101, and the compressed air 501 drives the piston 110 in order to press the master link plate 203 onto the master link pins 202. Excess or remaining compressed air is ejected from the cylinder 101 via the air release 121. The air release 121 is included on the cylinder 101 in order to enable the compressed air 501 the means with which to be dispensed after the piston 110 has pressed the master link plate 202. Dispensed compressed air 502 exits the cylinder 101 after the piston 110 has pressed the master link plate 202. Moreover, the dispensed compressed air 502 is fully evacuated from inside of the cylinder 101 upon the piston 110 returning to the original position via the springs 117.

Referring to FIG. 5, the piston 110 includes the neck 114, which forms a neck recess 128 with respect to the cylinder 101. The neck recess 128 is included in order to minimize the overall weight of the piston 110.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A pneumatically-operated master chain link press tool comprising:

a cylinder, a piston, and a compressed air source;

wherein said piston travels back and forth within said cylinder via the compressed air source said compressed air source drives said piston, which is configured to press a master link plate onto master link pins forming a master link of a drive chain;

wherein the cylinder is further defined with a first distal end, and an opposing distal end; wherein the first distal end includes a master link support jig that is accessed via a side opening, which is located adjacent to the first distal end; wherein the opposing distal end of the cylinder includes a compressed air inlet and an air release;

wherein the master link support jig has a master link body recess and link contours that face the first distal end of the cylinder.

2. The press tool as described in claim 1 wherein the side opening is further defined with an opening width; wherein the opening width of the side opening provides clearance to enable said drive chain to be inserted and removed when in use with the press tool.

3. The press tool as described in claim 2 wherein the master link body recess and link contours are specially shaped and spaced from one another in order for the master link of the drive chain to be secured onto the master link support jig; wherein the master link body recess and link contours support the master link at a strike distance from the first distal end of the cylinder such that the piston is able to extend in order to press the master link plate onto the master link pins.

4. The press tool as described in claim 3 wherein the piston is further defined with a master link face that actually impacts the master link plate; wherein the master link face includes pin recesses thereon, which enable the master link pins to extend through the master link plate.

5. The press tool as described in claim 4 wherein the piston is able to slide back and forth within the cylinder; wherein the piston; wherein the piston includes a neck that is located in between the master link face and a compressed air surface.

6. The press tool as described in claim 5 wherein a plurality of bearings are outfitted on the piston to ensure laminar movement of the piston back and forth within the cylinder.

7. The press tool as described in claim 6 wherein the cylinder includes springs that are supported within spring recesses located inside of the cylinder; wherein the springs are held in place via spring rods that are rigidly affixed within the spring recesses.

8. The press tool as described in claim 7 wherein the piston includes spring tabs that engage the springs such that the piston is biased into a retracted position; wherein the springs bias the piston to the retracted position, which pulls the piston towards the opposing distal end.

9. The press tool as described in claim 8 wherein the opposing distal end of the cylinder includes the compressed air inlet and the air release; wherein the compressed air source is supplied via a compressed air hose that connects to the compressed air inlet of the cylinder, and which supplies compressed air to the cylinder.

10. The press tool as described in claim 9 wherein the compressed air is ejected from the cylinder via the air release, and which enables dispensed compressed air the means with which to exit the cylinder after the piston is retracted via the springs, and which occurs after the piston drives the master link plate onto the master link pins.

11. A pneumatically-operated master chain link press tool comprising:

a cylinder, a piston, and a compressed air source;

wherein said piston travels back and forth within said cylinder via the compressed air source said compressed air source drives said piston, which is configured to press a master link plate onto master link pins forming a master link of a drive chain;

wherein the cylinder is further defined with a first distal end, and an opposing distal end; wherein the first distal end includes a master link support jig that is accessed via a side opening, which is located adjacent to the first distal end; wherein the opposing distal end of the cylinder includes a compressed air inlet and an air release;

wherein the master link support jig has a master link body recess and link contours that face the first distal end of the cylinder;

wherein the side opening is further defined with an opening width; wherein the opening width of the side opening provides clearance to enable said drive chain to be inserted and removed when in use with the press tool;

wherein the master link body recess and link contours are specially shaped and spaced from one another in order for the master link of the drive chain to be secured onto the master link support jig; wherein the master link body recess and link contours support the master link at a strike distance from the first distal end of the cylinder such that the piston is able to extend in order to press the master link plate onto the master link pins.

12. The press tool as described in claim 11 wherein the piston is further defined with a master link face that actually impacts the master link plate; wherein the master link face includes pin recesses thereon, which enable the master link pins to extend through the master link plate.

13. The press tool as described in claim 12 wherein the piston is able to slide back and forth within the cylinder; wherein the piston; wherein the piston includes a neck that is located in between the master link face and a compressed air surface.

14. The press tool as described in claim 13 wherein a plurality of bearings are outfitted on the piston to ensure laminar movement of the piston back and forth within the cylinder.

15. The press tool as described in claim 14 wherein the cylinder includes springs that are supported within spring recesses located inside of the cylinder; wherein the springs are held in place via spring rods that are rigidly affixed within the spring recesses.

16. The press tool as described in claim 15 wherein the piston includes spring tabs that engage the springs such that the piston is biased into a retracted position; wherein the springs bias the piston to the retracted position, which pulls the piston towards the opposing distal end.

17. The press tool as described in claim 16 wherein the opposing distal end of the cylinder includes the compressed air inlet and the air release; wherein the compressed air source is supplied via a compressed air hose that connects to the compressed air inlet of the cylinder, and which supplies compressed air to the cylinder.

18. The press tool as described in claim 17 wherein the compressed air is ejected from the cylinder via the air release, and which enables dispensed compressed air the means with which to exit the cylinder after the piston is retracted via the springs, and which occurs after the piston drives the master link plate onto the master link pins.

* * * * *